US008927943B2

(12) United States Patent
Yang et al.

(10) Patent No.: US 8,927,943 B2
(45) Date of Patent: Jan. 6, 2015

(54) DEVICE FOR OBTAINING THE ION SOURCE OF A MASS SPECTROMETER USING AN ULTRAVIOLET DIODE AND A CEM

(75) Inventors: Mo Yang, Daejeon (KR); Seung Yong Kim, Daejeon (KR); Hyun Sik Kim, Daejeon (KR)

(73) Assignee: Korea Basic Science Institute, Daejeon (KR)

( * ) Notice: Subject to any disclaimer, the term of this patent is extended or adjusted under 35 U.S.C. 154(b) by 0 days.

(21) Appl. No.: 14/125,491

(22) PCT Filed: Dec. 16, 2011

(86) PCT No.: PCT/KR2011/009749

§ 371 (c)(1),
(2), (4) Date: Dec. 11, 2013

(87) PCT Pub. No.: WO2013/042830

PCT Pub. Date: Mar. 28, 2013

(65) Prior Publication Data

US 2014/0124662 A1 May 8, 2014

(30) Foreign Application Priority Data

Sep. 20, 2011 (KR) ..... 10-2011-0094676

(51) Int. Cl.

| | |
|---|---|
| ***H01J 49/10*** | (2006.01) |
| ***H01J 49/00*** | (2006.01) |
| ***H01J 49/08*** | (2006.01) |
| ***H01J 49/42*** | (2006.01) |

(52) U.S. Cl.

CPC ..... *H01J 49/10* (2013.01); *H01J 49/0022* (2013.01); *H01J 49/08* (2013.01); *H01J 49/424* (2013.01)

USPC ..... 250/427; 250/281; 250/288; 250/423 R; 250/424

(58) Field of Classification Search

USPC ..... 250/281, 288, 423 R, 424, 427

See application file for complete search history.

(56) References Cited

U.S. PATENT DOCUMENTS

| | | | | |
|---|---|---|---|---|
| 3,555,345 | A * | 1/1971 | Collings et al. | 315/11 |
| 4,298,817 | A * | 11/1981 | Carette et al. | 313/362.1 |
| 4,950,939 | A * | 8/1990 | Tosswill | 313/103 CM |

(Continued)

FOREIGN PATENT DOCUMENTS

| | | | |
|---|---|---|---|
| JP | 11-040069 | A | 2/1999 |
| KR | 10-2010-0112136 | A | 10/2010 |

*Primary Examiner* — Michael Logie

(74) *Attorney, Agent, or Firm* — Rabin & Berdo, P.C.

(57) ABSTRACT

The present invention relates to a device for obtaining the ion source of a mass spectrometer using an ultraviolet diode and a CEM module, having the purpose of inducing initial electron emission using a CEM module and by radiating ultraviolet photons emitted from the ultraviolet diode to the entrance of the CEM module to obtain a large amount of amplified electron beams from the exit and to produce electron beams the emission times of which are accurately controlled at low temperature and at low power. The present invention is characterized by a device for obtaining the ion source of a mass spectrometer using an ultraviolet diode and a CEM module, the device consisting essentially of: an ultraviolet diode emitting ultraviolet rays by means of supplied power; an electron multiplier inducing and amplifying the initial electron emission of ultraviolet photons from the ultraviolet diode and obtaining a large amount of electron beams from the exit; an electron condenser lens condensing the electron beams amplified by the electron multiplier; an ion trap mass separator ionizing gas sample molecules by the electron beams injected through the electron xondensing lens; and an ion detector detecting ions separated from the ion trap mass separator by mass spectrum, wherein the electron multiplier is a CEM module.

3 Claims, 2 Drawing Sheets

(56) References Cited

U.S. PATENT DOCUMENTS

| | | | | |
|---|---|---|---|---|
| 5,089,702 | A * | 2/1992 | Allemann et al. | 250/291 |
| 5,521,380 | A * | 5/1996 | Wells et al. | 250/282 |
| 5,659,170 | A * | 8/1997 | Da Silveira et al. | 250/287 |
| 5,852,295 | A * | 12/1998 | Da Silveira et al. | 250/423 R |
| 6,239,549 | B1 * | 5/2001 | Laprade | 313/533 |
| 6,596,990 | B2 * | 7/2003 | Kasten et al. | 250/292 |
| 6,762,406 | B2 * | 7/2004 | Cooks et al. | 250/292 |
| 2014/0044239 | A1 * | 2/2014 | Gendreau et al. | 378/123 |

* cited by examiner

DEVICE FOR OBTAINING THE ION SOURCE OF A MASS SPECTROMETER USING AN ULTRAVIOLET DIODE AND A CEM

TECHNICAL FIELD

The present invention relates to an electron gun for ionizing gaseous molecules in a mass analyzer and, more particularly, to a device for acquiring an ion source of a mass analyzer using an ultraviolet (UV) diode and a channeltron electron multiplier (CEM) module, in which cold electrons are produced at room temperature using the UV diode and the CEM module, without using a thermionic emission method based on a high temperature and a high current, and are applied to the mass analyzer.

BACKGROUND ART

In general, to separate molecular ions to analyze components according to the masses of the ions in a mass analyzer, first, a process of ionizing gaseous molecules is required.

A method of bombarding the gaseous molecules with an electron beam to produce the molecular ions is most frequently used. To produce the electron beam, a device for heating a filament at a high temperature to induce thermionic emission is most widely used.

The filament can be heated at a high temperature by causing a high current to flow to a high-temperature metal such as tungsten or rhenium. However, due to high power consumption, battery power is rapidly consumed in a portable mass analyzer, and a reaction to electron emission caused by a rise to a high temperature is slow. As such, it is difficult to control the electron emission in a mass analyzer that is suitable to produce a continuous output electron beam and requires pulse ionization within a short time.

DISCLOSURE

Technical Problem

Accordingly, the present invention is directed to a device for acquiring an ion source of a mass analyzer using an ultraviolet (UV) diode and a channeltron electron multiplier (CEM) module, in which the CEM module is used to produce a portable mass analyzer, UV photons emitted from the UV diode is applied to an inlet of the CEM module and induces initial electron emission, the emitted electrons are amplified into an electron beam in quantity at an outlet of the CEM module, and the electron beam in which an emission time thereof is accurately adjusted with a low temperature and low power is obtained.

Technical Solution

According to an aspect of the present invention, there is provided a device for acquiring an ion source of a mass analyzer using an ultraviolet (UV) diode and an channeltron electron multiplier (CEM) module, in which electrons generated by UV photons are amplified into an electron beam using the UV diode and the CEM module, the electron beam ionizes gaseous sample molecules to produce ions, and the ions are detected. The device includes: the UV diode that emits UV using supplied power; the EM module that causes the UV photons from the UV diode to induce initial electron emission and amplifies the emitted electrons into a large quantity of electron beam at an outlet thereof; an electron beam focusing lens that focuses the electron beam amplified through the EM module; an ion trap mass separator that ionizes the gaseous sample molecules to produce ions using the electron beam injected by the electron beam focusing lens; and an ion detector that detects the ions produced by the ion trap mass separator based on a mass spectrum. The EM module is a channeltron electron multiplier (CEM) module.

Advantageous Effects

As described above, the device for acquiring an ion source of a mass analyzer using an ultraviolet (UV) diode and an channeltron electron multiplier (CEM) module can produce the electron beam for ionizing the gaseous molecules at a low temperature without using a high temperature and a high current, reduce a size, weight, and battery power consumption when applied to a small mass analyzer because only a necessary quantity of electron beam is produced at a necessary time, be applied to a portable mass analyzer. Further, a thin electron beam is emitted, and is thus focused with relative ease.

MODE FOR INVENTION

Hereinafter, exemplary embodiments of the present invention will be described in detail below with reference to the attached drawings. While the present invention is shown and described in connection with exemplary embodiments thereof, it will be apparent to those skilled in the art that various modifications can be made without departing from the spirit and scope of the invention.

A device for acquiring an ion source of a mass analyzer using an ultraviolet (UV) diode and a channeltron electron multiplier (CEM) module, in accordance with an embodiment of the present invention will be described below in detail with reference to the attached drawings.

Figure 1:
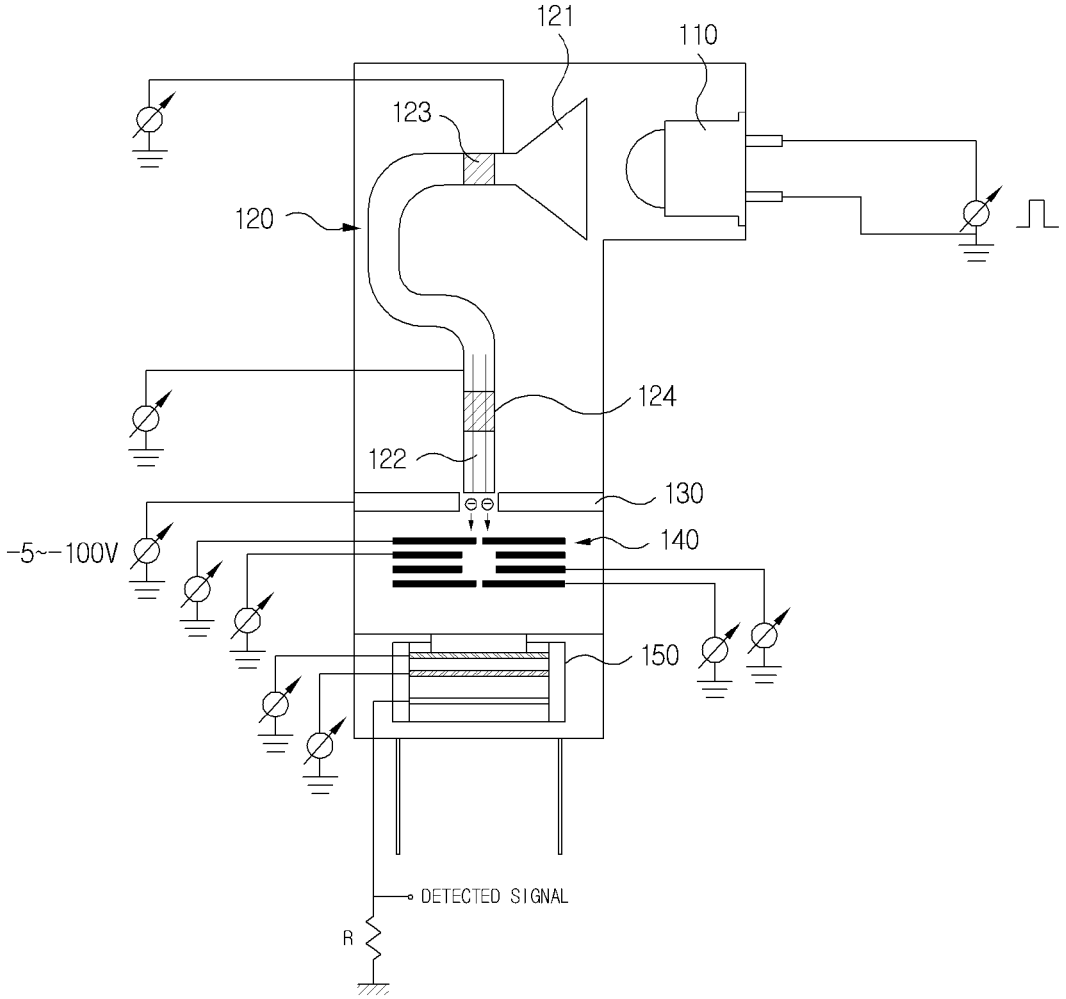
FIG. 1 shows an overall configuration of a device for acquiring an ion source of a mass analyzer using an ultraviolet (UV) diode and a channeltron electron multiplier (CEM) module in accordance with an embodiment of the present invention.

FIG. 1 shows a configuration of a device for acquiring an ion source of a mass analyzer using a UV diode and a CEM module in accordance with an embodiment of the present invention. The device includes a UV diode 110 emitting UV using supplied power, a CEM module 120 that causes UV photons from the UV diode 110 to induce initial electron emission and amplifies the emitted electrons into a large quantity of electron beam, first and second insulators 123 and 124 insulating inlet and outlet sides of the CEM module 120 so that negative voltages are applied to the respective inlet and outlet sides of the CEM module 120, an electron beam focusing lens 130 focusing the electron beam amplified through the CEM module 120, an ion trap mass separator 140 ionizing gaseous sample molecules to produce ions using the electron beam injected through the electron beam focusing lens 130, and an ion detector 150 detecting the ions produced by the ion trap mass separator 140 based on a mass spectrum.

Each component of the mass analyzer is operated in a vacuum chamber having a pressure of $10^{-3}$ to $10^{-11}$ Torr.

Here, the CEM module 120 is configured so that the UV photons emitted from the UV diode 110 is applied at the side of the inlet 121 thereof, and the electrons generated by the UV photons applied to the inlet are amplified at the outlet 122 thereof.

An operation of the ion source acquiring device configured in this way will be described below in greater detail with reference to FIGS. 1 and 2.

The UV emitted from the UV diode 110 is applied to the inlet 121 of the CEM module, and the UV photons induce the initial electron emission at the inlet 121 of the CEM module.

In detail, the electrons generated in quantity by the UV are amplified into the electron beam when passing through a vacuum tube of the CEM module 120. The electron beam amplified up to 1,000,000 times can be obtained at the outlet 122 of the CEM module.

Figure 2:
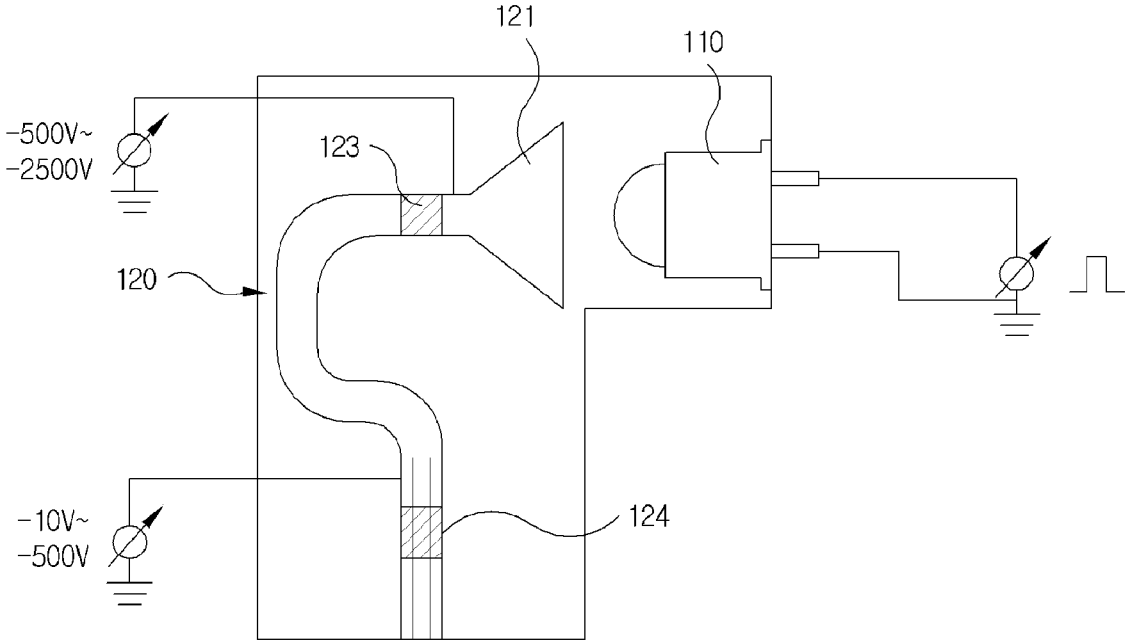
FIG. 2 shows a configuration of the CEM module shown in FIG. 1.

As shown in FIG. 2, negative voltages are applied to the inlet 121 and outlet 122 of the CEM module 120. To be specific, a negative voltage of −500 V to −2500 V is applied to the inlet 121 of the CEM module, and a negative voltage of −10 V to −500 V is applied to the outlet 122 of the CEM module. To apply the negative voltages to the respective inlet and outlet sides of the CEM module, the first and second insulators 123 and 124 insulate the inlet and outlet sides of the CEM module.

The electron beam amplified by the CEM module 120 is focused in one direction by the electron beam focusing lens 130, and is injected into the ion trap mass separator 140.

A negative voltage higher than that applied to the outlet 122 of the CEM module is applied to the electron beam focusing lens 130. Preferably, a negative voltage of −5 V to −100 V is applied.

The ion trap mass separator 140 ionizes the gaseous molecules using the injected electron beam and voltages applied to respective electrodes.

Here, the ionization is adjusted by a UV emission time and UV intensity of the UV diode 110. In detail, the ionization is adjusted by an on/off pulse signal of the power applied to the UV diode 110. When the on pulse signal is applied for a long time, a large quantity of UV is emitted. When the on pulse signal is applied for a short time, a small quantity of UV is emitted.

Further, the UV emission time of the UV diode 110 is adjusted so as to be able to accurately momentarily obtain an electron current required for a time for which gas ionization is required in the mass analyzer.

The ion detector 150 detects the ions produced by the ion trap mass separator 140, and the detected ions are detected as signals based on the mass spectrum by a principle of the ion trap mass separator.

In this way, the device for acquiring an ion source of a mass analyzer using a UV diode and an CEM module in accordance with an embodiment of the present invention can be applied to an electron capture dissociation (ECD) device or an electron transfer dissociation (ETD) device used in a portable mass analyzer or a tandem mass analyzer.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. A device for acquiring an ion source of a mass analyzer, the device comprising:

an ultraviolet (UV) diode emitting UV, a quantity of the UV being adjusted by an emission time and intensity of the UV;

an electron multiplier (EM) module in which UV photons emitted from the UV diode induces an initial electron emission, amplifies electrons emitted by the initial electron emission and obtains a large quantity of electron beam at an outlet thereof;

an electron beam focusing lens focusing the large quantity of electron beam amplified through the EM module;

an ion trap mass separator ionizing gaseous molecules to produce ions using the large quantity of electron beam injected through the electron beam focusing lens; and an ion detector detecting the ions produced by the ion trap mass separator based on a mass spectrum;

a first insulator disposed in an inlet side of the EM module for applying a first negative voltage to the inlet side; and a second insulator disposed in an outlet side of the EM module for applying a second negative voltage to the outlet side, the second insulator being separated from the first insulator, wherein the first negative voltage is in a range of −500 V to −2500 V, and the second negative voltage is in a range of −10 V to −500 V.

2. The device of claim 1, wherein the emission time and intensity of the UV is adjusted by an on/off time of a supplied power to the UV diode.

3. The device of claim 1, wherein the UV diode, the EM module, the electron beam focusing lens, the ion trap mass separator and the ion detector are provided in a vacuum chamber having a pressure of $10^{-3}$ to $10^{-11}$ Torr.

* * * * *